US005915802A

United States Patent [19]

Siler

[11] Patent Number: 5,915,802

[45] Date of Patent: Jun. 29, 1999

[54] AUTOMATIC TELLER MACHINE (ATM) CASSETTE SECURITY SYSTEM

[76] Inventor: Buzz Siler, 3328 Lakeview Blvd., Lake Oswego, Oreg. 97035

[21] Appl. No.: 08/964,248

[22] Filed: Nov. 4, 1997

[51] Int. Cl.[6] ..... E05B 65/46

[52] U.S. Cl. ..... 312/216; 312/219; 312/107.5; 109/47

[58] Field of Search ..... 312/216, 217, 312/219, 107.5, 308, 326, 220; 109/47, 57

[56] References Cited

U.S. PATENT DOCUMENTS

| | | | |
|---|---|---|---|
| 788,966 | 5/1905 | Upton | 312/107.5 |
| 2,775,947 | 1/1957 | Mosler | 109/47 |
| 2,803,512 | 8/1957 | Band | 312/216 X |
| 3,002,800 | 10/1961 | McMahan | 312/216 |
| 3,815,389 | 6/1974 | Richards, Sr. | 312/216 X |
| 3,970,010 | 7/1976 | Contley | 109/47 X |
| 4,186,977 | 2/1980 | Gilovich et al. | 312/219 X |
| 5,103,659 | 4/1992 | Benefield, Sr. | 312/216 X |
| 5,797,487 | 8/1998 | Young | 312/216 X |

*Primary Examiner*—Peter M. Cuomo
*Assistant Examiner*—James O. Hansen
*Attorney, Agent, or Firm*—Olson and Olson

[57] ABSTRACT

An automatic teller machine (ATM) cassette security system divides the interior compartment of an automatic teller machine into a service-related area and a cash-related security area. A lock bar positioned to prevent access to cash cassettes establishes the cash-related security area while allowing service-related activities. The security system may be modified to also prevent movement of the transport housing by modification to the lock bar.

14 Claims, 4 Drawing Sheets

AUTOMATIC TELLER MACHINE (ATM) CASSETTE SECURITY SYSTEM

FIELD OF THE INVENTION

The present invention relates generally to security devices, and particularly to security and locking arrangements for automatic teller machines (ATMs).

BACKGROUND OF THE INVENTION

An automatic teller machine allows persons to acquire cash by interacting with the machine, e.g., by inserting a bank card associated with a particular bank account or credit account and entering a personal identification number (PIN). Automatic teller machines couple electronically to a banking network by telephone connection to obtain authorization for withdrawal of funds from a particular account or to apply a debit to a particular credit account. Once the transaction is approved, the automatic teller machine dispenses cash to the user.

Some automatic teller machines also allow deposit of funds into a particular bank account, e.g., receive cash or checks. For example, once the user inserts the bank card and enters the appropriate PIN, the automatic teller machine requests that the user place the funds in an envelope and then insert the envelope into a special slot in the automatic teller machine. Thus, an automatic teller machine dispenses cash and may receive cash or checks in response to user interaction. Automatic teller machines include paper transport mechanisms appropriate for moving cash into and out of the machine, i.e., for moving cash from a cash cassette or drawer out of the machine or for receiving a deposit envelope and placing that envelope into a vault deposit receptacle.

Because automatic teller machines handle cash and in some cases bank account deposits, a significant level of security must be present to protect automatic teller machine contents against theft. Early automatic teller machines were typically incorporated into a wall structure, e.g., the exterior wall of a bank, and the public had access only to a front panel of the automatic teller machine. Bank employees could access the back side of the automatic teller machine from inside the bank to perform such tasks as restocking the cash inventory and taking deposits from the vault portion of the automatic teller machine. Automatic teller machines have evolved significantly, however, and are now found in a variety of locations such as at grocery stores, gas stations, shopping malls, small convenience stores, and the like. Furthermore, automatic teller machines are often stand-alone structures, i.e., not incorporated into a wall structure. Accordingly, such stand-alone automatic teller machines are particularly vulnerable to theft and require relatively higher level security systems.

Automatic teller machines also require routine maintenance tasks. For example, automatic teller machines dispense transaction receipts on printed slips, and an inventory of such slips must be maintained in the automatic teller machine. Also, the printing device producing transaction slips may require maintenance, e.g., to fix paper jams and to supply printing media. Also, electronic control circuitry requires service, e.g., may require a reset operation or other such manipulation or repair of the electronic components. Clearly, retrieval of accumulated deposits and replenishment of cash reserves for withdrawals are very frequent services which require entry into the confines of the automated teller machines.

Thus, automatic teller machines require intermittent service and, therefore, require that persons performing such service tasks have access to the interior of the automatic teller machine. Any person responsible for performing such tasks as re-supplying transaction slip paper, fixing paper jams, manipulating electronic circuitry, retrieving deposits and re-supplying cash reserves and the like cannot represent a security risk to the automatic teller machine. In other words, any person performing such service tasks must be trusted at the highest level or they must be accompanied by bank or security personnel in order to satisfy double custody security requirements. Clearly, the cost of these necessary security measures is high, particularly when considering the great number of machines in use throughout the nation, and indeed, the world.

A typical automatic teller machine is a cabinet with a front portion providing a terminal screen, key pad, and various slots for conducting interaction and transactions with a user. The cabinet also includes a hinged door providing access to the interior of the cabinet. As may be appreciated, the cabinet itself is a high security enclosure with substantial structure and locking mechanisms for the access door. Within the interior compartment, a variety of components may be found. Typically, these components include electronic circuitry, a printing mechanism, and a stack of drawers or cassettes holding a cash inventory and providing a vault portion of the automatic teller machine. To facilitate service and access to the various components, the entire assembly mounts typically upon a slidable transport carriage and housing arrangement allowing the assembly to be moved at least partially out of the automatic teller machine cabinet enclosure for service access.

The subject matter of the present invention provides a security system for an automatic teller machine resolving the inherent conflict between the need for service-related access to the interior compartment of an automatic teller machine and the important need for security against theft of automatic teller machine contents, specifically in the present matter, the cash casettes and their contents.

SUMMARY OF THE INVENTION

An automatic teller machine security system under the present invention incorporates a cash cassette lock bar attached to the cash cassette transport housing. The lock bar includes structures interlocking to the transport housing and a lock mechanism securing the lock bar in place thereby preventing access to such portions of the automatic teller machine as the cash drawers and vault drawer. Other portions of the automatic teller machine such as the electronic circuitry and printing mechanism, however, may be accessed even with the lock bar in its secured condition. Accordingly, an automatic teller machine with a security system under the present invention allows access to the interior compartment of the automatic teller machine for service, while securing against access to the relatively higher security portions of the automatic teller machine containing the cash cassette drawers and cash diverter unit. In this manner, a wider range of persons may be allowed access to the interior compartment of the automatic teller machine without risking theft of cash contained therein for customer withdrawals. Furthermore, with such a security bar in place, persons accessing the interior compartment by destructive means encounter yet another barrier to obtaining cash from the automatic teller machine. Accordingly, destructive methods of accessing the automatic teller machine contents take significantly longer time and, therefore, provide significantly greater opportunity for intervention.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which.

DETAILED DESCRIPTION OF THE PREFERRED EMBODIMENT

The preferred embodiment of the present invention will be illustrated relative to several specific forms of automatic teller machines. It will be understood, however, that the subject matter of the present invention may be applied to a variety of automatic teller machine configurations.

Figure 1:
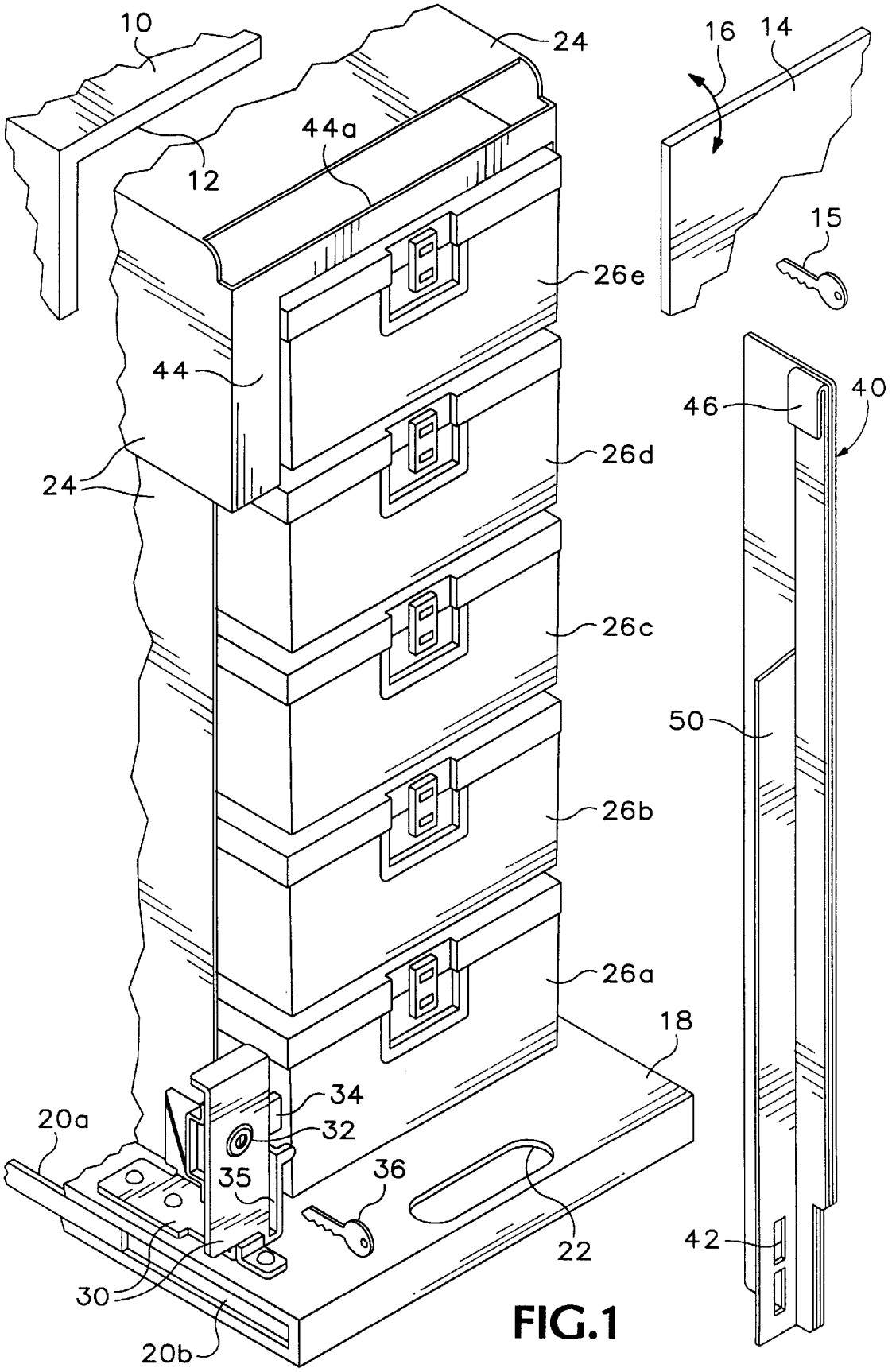
FIG. 1 is a fragmentary, perspective view illustrating parts of an automatic teller machine including a security system with a cassette lock bar shown detached relative to the automatic teller machine transport carriage.

FIG. 1 illustrates partially an automatic teller machine incorporating a security system according to a preferred embodiment of the present invention. More particularly, FIG. 1 illustrates partially a cabinet 10 defining an interior compartment 12 and illustrates partially an access door 14 pivoting between an open and closed position as indicated at reference numeral 16. As may be appreciated, door 14 and cabinet 10 couple by locking mechanism (not shown) whereby members of the public cannot access compartment 12. Certain persons, e.g., the automatic teller machine owner and authorized service personnel, can open door 14 with a key 15 when necessary.

Within compartment 12, a transport carriage 18 mounts slidably to the interior portion of cabinet 12 in various conventional manners, such as upon sliding rails 20, individually 20*a* and 20*b*, on the left side of transport carriage 18 (as shown in FIG. 1) and on the right side (not shown in FIG. 1) of transport carriage 18. Transport carriage 18 thereby slides freely on rails 20 and may be moved partially out of compartment 12 when door 14 is in its open position. The carriage 18 may include a handle aperture 22 to allow a person to grasp transport carriage 18 for movement. A transport housing 24 mounts permanently and in secure fashion to transport carriage 18 and extends vertically upward therefrom. Accordingly, moving transport carriage 18 into and out of compartment 12 also moves transport housing 24 into and out of compartment 12. Transport housing 24 is a secure structure, e.g., constructed of substantial steel panels, and as discussed more fully hereafter contains a plurality of cash cassettes 26*a* and typically diverter cassette 26*e*.

In accordance with the present invention, a base lock bracket 30 attaches in secure fashion, e.g., by rivets, welding or non-removable mounting bolts, to transport carriage 18 and housing 24. Base lock bracket 30 includes a security key lock 32 operating a latch 34. As may be appreciated, inserting key 36 into security key lock 32 and rotating key 36 causes lateral movement of latch 34 relative to base lock bracket 30.

Figure 2:
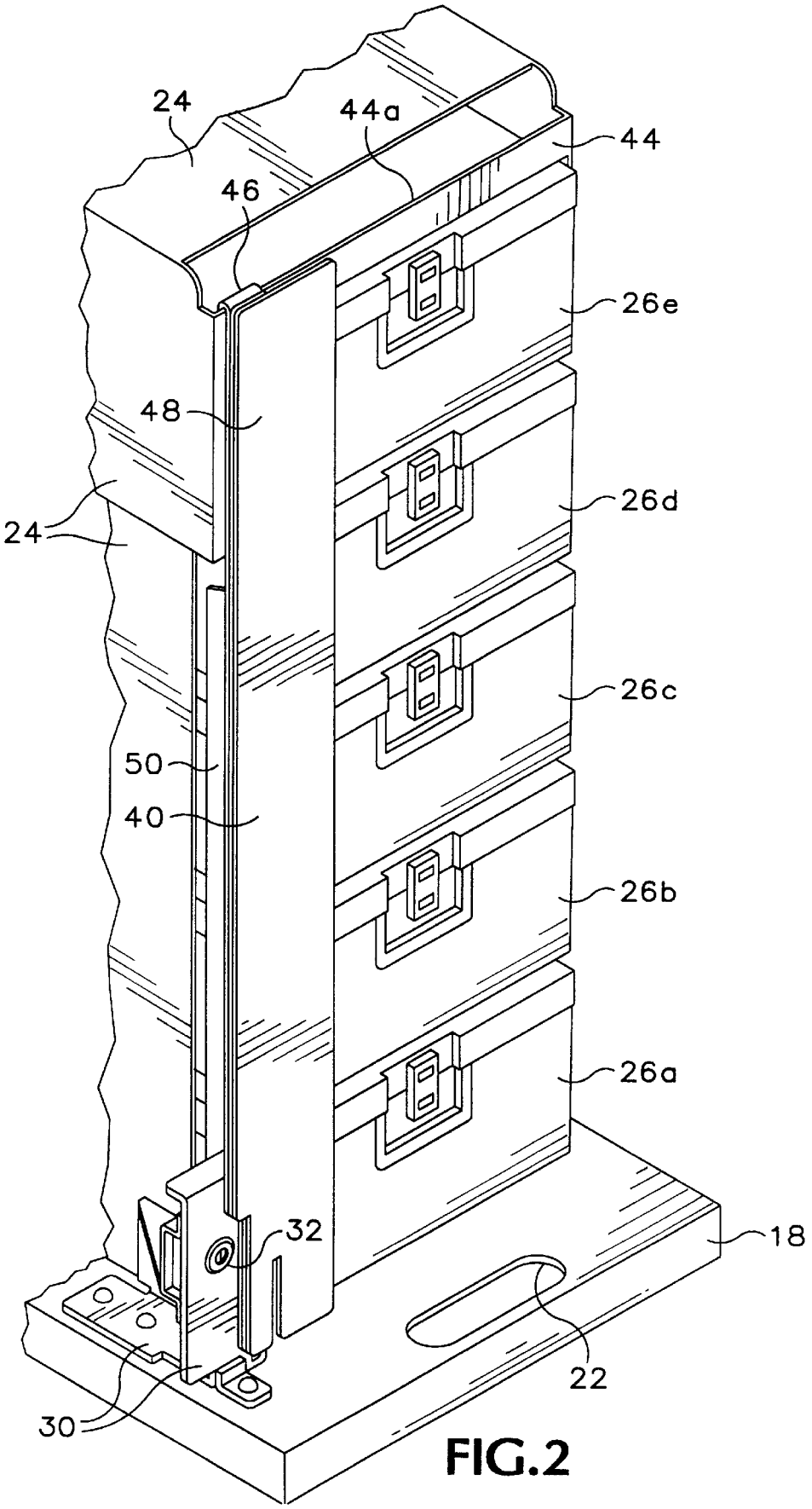
FIG. 2 is a fragmentary, perspective view illustrating the automatic teller machine of FIG. 1, but with the cassette lock bar attached in its securing position.

A cassette lock bar 40 couples to transport housing 24 and to base lock bracket 30. Latch 34 moves into a latch keeper aperture 42 of lock bar 40 to secure lock bar 40 in position. FIG. 2 illustrates lock bar 40 as secured to transport housing 24 and to base lock bracket 30. With reference to FIGS. 1 and 2, transport housing 24 includes a front wall 44 with exposed top edge 44*a*. Cassette lock bar 40 includes a hook member 46 at its upper end adapted to rest at its bight on edge 44*a* as illustrated in FIG. 2. Flange plate 50 projects rearward and in orthogonal relation to the face plate 48 of lock bar 40. Keeper aperture 42 is formed in flange plate 50 and, with hook member 46 resting on top edge 44*a*, receives latch 34 of security lock 32. Flange plate 50 projects into a space between cassettes 26 and the side wall of housing 24. As may be appreciated, with hook 46 resting on edge 44*a*, flange 50 projecting into a space between housing 24 and cassettes 26, and latch 34 engaging aperture 42, lock bar 40 is held against movement in any direction. More particularly, hook 46 and latch 34 together with aperture 42 prevent prying of lock bar 40 away from wall 44. With flange plate 50 lying along the left wall of cassettes 26, lock bar 40 cannot be moved rightward. Lock bar 40 cannot be moved leftward because of lock bracket 30 being positioned immediately leftward of flange plate 50 and the left wall of housing 24 being positioned immediately leftward of hook 46. Lock bar 40 can only be removed from block 30 and housing 24 by destructive, and time-consuming, methods. Thus, positioning cassette lock bar 40 relative to transport housing 24 as illustrated in FIG. 2 and operating key 36 causes latch 34 to engage keeper aperture 42 and thereby secure cassette lock bar 40 in position relative to transport housing 24. Flange plate 50 provides substantial additional structure integrity to lock bar 40 to stabilize bar 40 against deformation such as in response to the impact of a vandal's sledge hammer. With reference to FIG. 1, block 30 includes a slot 35 receiving the lower end of flange plate 50 whereupon engagement of latch 34 within aperture 42 of plate 50 positively locks bar 40 relative to block 30.

Transport housing 24 contains a stack of cassettes 26, individually cash cassettes 26*a*–26*d* and diverter cassette 26*e*. Persons having access to compartment 12 cannot access the interior of cassettes 26 without key 36, i.e., without an ability to remove cassette lock bar 40 from its secure position as illustrated in FIG. 2. Transport carriage 18 can, however, be moved partially out of compartment 12 for purposes of servicing the automatic teller machine, e.g., loading transaction slip paper, servicing the printing device, or servicing the electrical circuitry of the automatic teller machine. The security system of the present invention thereby bifurcates an automatic teller machine into two security zones within the interior compartment 12 of cabinet 10. Cabinet 10 itself prevents access to the interior compartment 12 by virtue of the locking mechanism (not shown) and key 15 for door 14. Persons having access to interior compartment 12 have access to service-related aspects of the automatic teller machine, but do not have access to cassettes 26. Cassettes 26 constitute a relatively higher security zone within compartment 12 established by virtue of cassette lock bar 40. The embodiment of the present invention as illustrated in FIGS. 1 and 2 thereby allows movement of transport carriage 18 when needed for service persons having legitimate access to interior compartment 12, but does not allow access to cassettes 26. Only persons having access both to compartment 12 and to key 36 can access cassettes 26.

Figure 3:
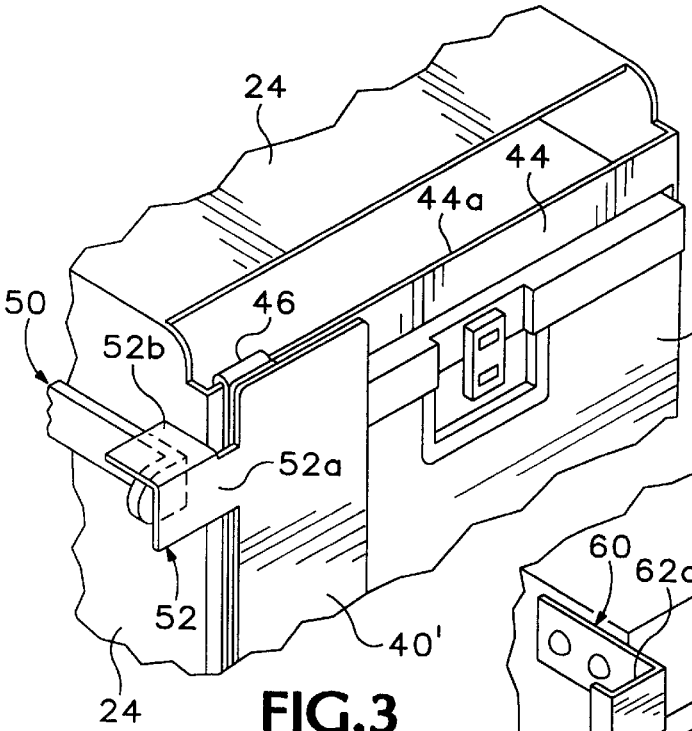
FIG. 3 illustrates a first alternative arrangement of the present invention for a particular automatic teller machine transport mechanism.

Cassette lock bar 40 may be modified, however, to also prevent movement of transport carriage 18. For example, FIG. 3 illustrates an automatic teller machine having a lever 50 for releasing transport carriage 18 (not shown in FIG. 3) and allowing movement of transport housing 24. In FIG. 3, cassette lock bar 40' includes a lever shield 52, including a vertical wall 52*a* and a horizontal wall 52*b*. With lock bar 40' in its secure position, i.e., coupled to base lock bracket 30 (not shown in FIG. 3) and hook 46 coupled to top edge 44*a*, vertical wall 52*a* resides directly in front of lever 50 and horizontal wall 52*b* resides directly over lever 50. In such position, lever shield 50 prevents movement of lever 50, and thereby prevents release of transport carriage 18. Thus, only persons having access to key 36 (FIG. 1) can release lever 50 and move transport housing 24 of the automatic teller machine illustrated in FIG. 3.

Figure 4:
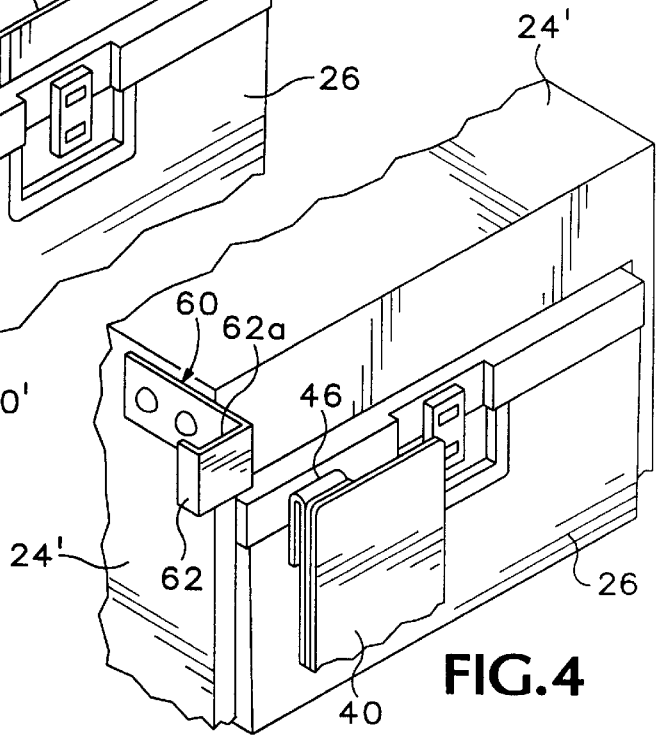
FIG. 4 illustrates a second alternative arrangement of the present invention for a particular automatic teller machine configuration.

FIG. 4 illustrates modification to an automatic teller machine not having an exposed top edge 44*a* or similar such structure for coupling to hook 46 of lock bar 40. In FIG. 4, a transport housing 24' has attached at a vertical side wall an upper mounting bracket 60. Bracket 60 extends outward from transport housing 24' and includes a front wall 62 with an exposed top edge 62*a*. Hook 46 of lock bar 40 rests on top edge 62*a* in similar fashion to its position relative to top edge 44*a* as described in FIGS. 1 and 2. Thus, transport housing 24' is modified to accommodate use of lock bar 40 to secure cassettes 26 within transport housing 24'.

Figure 5:
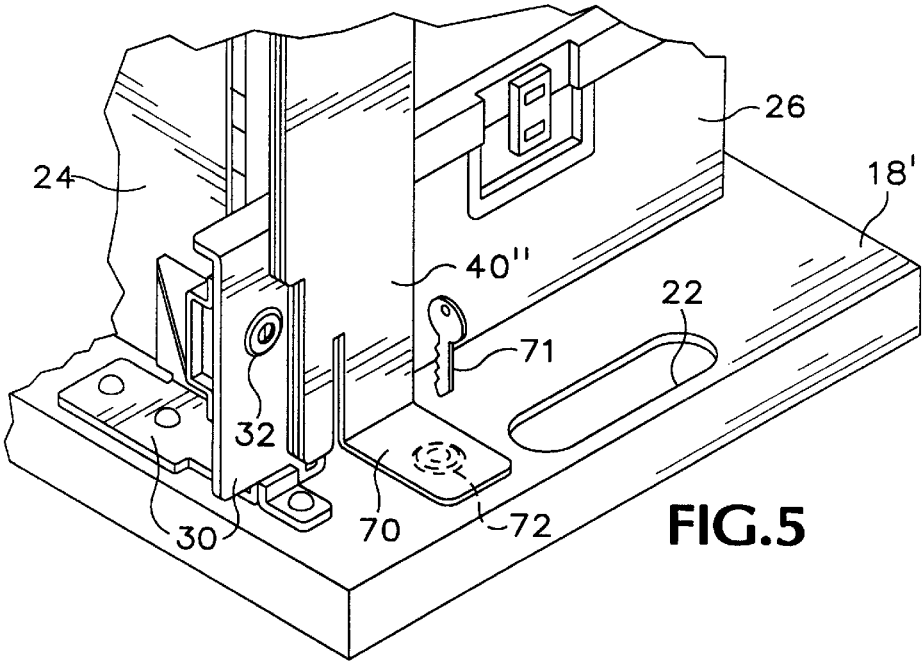
FIG. 5 shows a modification of the cassette lock bar for a particular automatic teller machine configuration.

FIG. 5 illustrates another modification which may be applied to lock bar 40 to prevent unauthorized movement of transport carriage 18'. In FIG. 5, lock bar 40" is similar to the above-described lock bar 40, but includes a foot plate 70 extending from the lower end of lock bar 40" and along the upper surface of transport carriage 18' to cover a transport carriage lock 72. In this form of automatic teller machine, transport carriage 18' cannot be moved unless one has access to transport carriage lock 72 and its associated key 71. Foot plate 70 prevents access to lock 72, and thereby prevents movement of carriage 18' when lock bar 40" is in its secure position, i.e., as coupled to lock base 30 and secured by means of security key lock 32. In this configuration, lock bar 40 prevents both movement of transport carriage 18' and access to cassettes 26. The footplate 70 may be configured differently as may be needed to accommodate the covering of lock 72 disposed in other locations on the transport carriage 18'.

Figure 6:
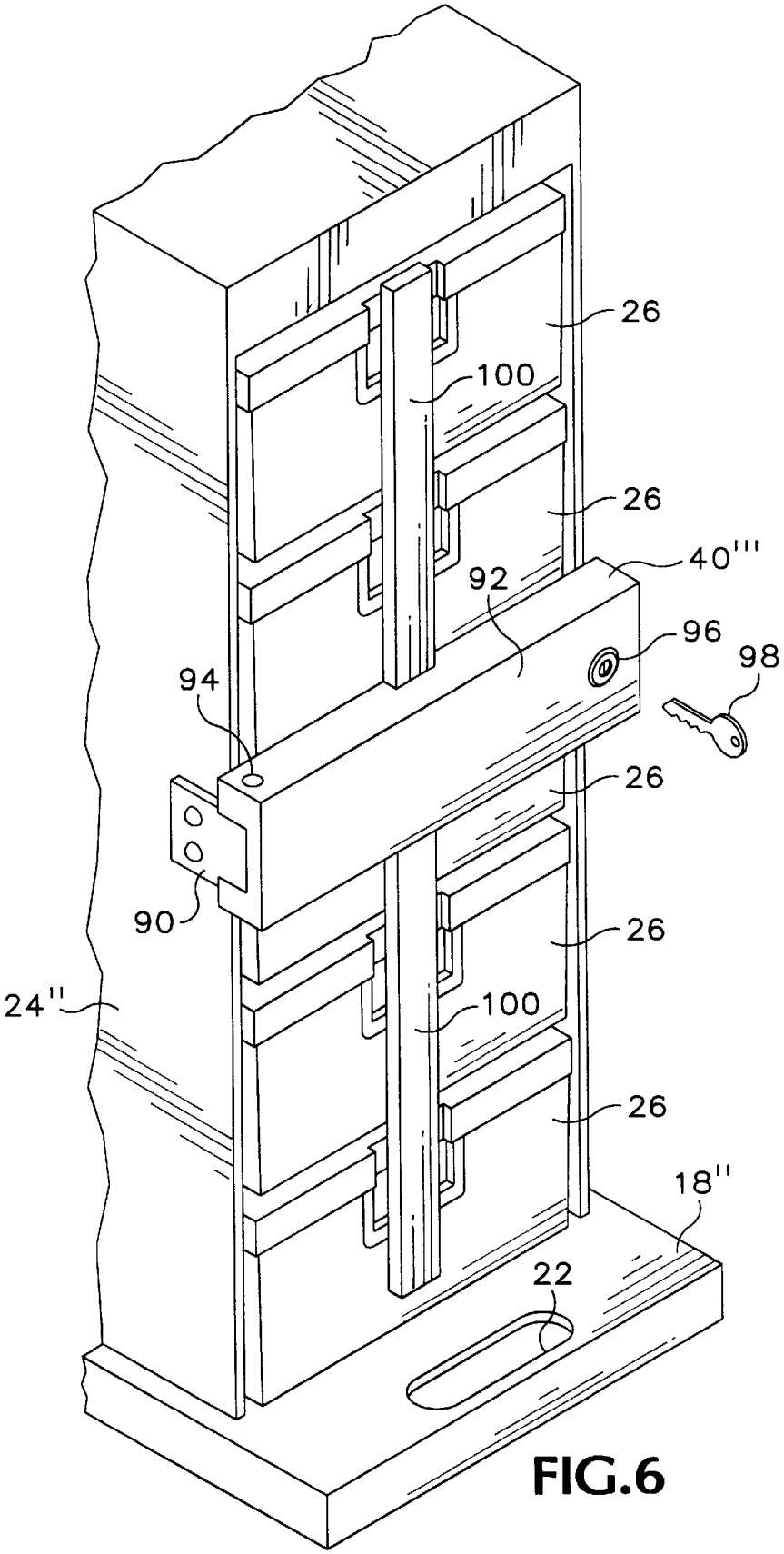
FIG. 6 shows a second embodiment of the present invention showing a pivoting cassette lock bar configuration.

FIG. 6 illustrates another embodiment of the present invention applicable to an automatic teller machine similar to that discussed above including a cabinet 10 defining an interior compartment 12, a door 14 secured by a locking mechanism, and a transport carriage and housing in sliding relation to the cabinet 10. FIG. 6 illustrates, however, only the transport mechanism 18" and associated transport housing 24" mounted thereon. A security bar 40'" includes a hinge bracket 90 secured to a side wall of transport housing 24" and includes a lock bar 92 attached in secure hinged fashion to bracket 90, i.e., pivots at hinge 94. Bar 92 also couples to transport housing 24" by means of key lock 96 operable by use of key 98. Extending vertically upward and downward from and securely coupled to bar 92 is a block bar 100. With bar 92 in its locked position as illustrated in FIG. 6, block bar 100 prevents removal of cassettes 26. Accordingly, cassettes 26 can only be removed from housing 24" by use of key 98 to operate lock 96 and move pivot bar 92 to an open position. Thus, lock bar 40'" as illustrated in FIG. 6 allows movement of transport carriage 18" relative to cabinet 10 (not shown in FIG. 6) but does not allow access to cassettes 26.

Security provided under the present invention prevents access to cassettes 26 even though a person may have access to the interior compartment 12 of an automatic teller machine. Thus, for persons not having the necessary keys to operate the various locks, access to cassettes 26 must be accomplished through destructive procedures, e.g., breaking or destroying portions of the automatic teller machine to gain access to the cash therein. While not illustrated herein, it will be understood that automatic teller machines such as shown herein employ electronic alarm devices triggered in response to unauthorized or destructive access to the interior compartment 12 of the automatic teller machine. Such alarm devices would typically also include notification to an appropriate police authorities. Thus, destructive access or tampering with an automatic teller machine results in police notification, and prompt arrival of police authorities at the scene of the crime. While no security system can prevent absolutely access to the cash contained within an automatic teller machine, security systems under the present invention can successfully prevent theft of cash within an automatic teller machine by delaying the process, i.e., by making more difficult and time-consuming access to cash within an automatic teller machine.

The strategy of protection provided under the present invention with respect to persons willing to use destructive methods of access is to delay significantly ultimate access to cash within cassettes 26. More particularly, persons destroying portions of an automatic teller machine typically will not engage in such activity for extended periods of time due to the triggering of alarm systems associated with automatic teller machines. To accomplish a successful theft of cash from an automatic teller machine, one must act quickly. For thieves breaking open cabinet 12 and gaining access to interior compartment 12 by destructive process, presentation of lock bar 40 adds significantly to the time required to access cash within cassettes 26. Accordingly, such thieves may immediately abandon their effort to steal cash.

In conventional automatic teller machines, once door 14 has been opened, the cassettes 26 may be freely withdrawn from transport housing 24. Cassettes 26 even include handles making the task of carrying away cassettes 24 even easier. Incorporation of the security system of the present invention, however, prevents a thief from simply withdrawing cassettes 26 from transport housing 24. More particularly, the thief must now deal with lock bar 40 to gain access to cassettes 26. While it is possible to break loose lock bar 40 given the appropriate equipment and time, the particular configuration and structure of lock bar 40 makes such task significantly time consuming and significantly increases the opportunity for capture of a thief attempting to circumvent lock bar 40. Alternatively, the thief must resort to destroying the cash cassettes themselves, after which he must then collect and provide for carrying loose paper currency, a further time-consuming process enhancing the prospect of capture or at worst, the theft of a significantly lesser amount of money. Thus, lock bar 40 either deters a thief from continued attempts to access cassettes 26 because of the time required, or occupies a thief for sufficient time to allow police to respond to an alarm indicating unauthorized access to or tampering with the automatic teller machine.

Thus, an improved security system for an automatic teller machine has been shown and described. The security system of the present invention creates a higher security region within an automatic teller machine preventing access to cash cassettes while allowing access to service components of the automatic teller machine. In this manner, low-level employees may be allowed access to the interior compartment of an automatic teller machine without risking access to and providing opportunity for theft. The security system may be modified to also provide additional security against access to the transport mechanism to prevent movement of the transport housing if desired. The security system of the present invention may be modified to adapt for use to a variety of automatic teller machine configurations. With respect to persons employing destructive methods to gain access to cash within an automatic teller machine, the security system of the present invention significantly delays access to cash and thereby either deters such theft or delays such theft enough to allow capture in response to an automatic teller machine alarm indicating unauthorized access.

It will be appreciated that the present invention is not restricted to the particular embodiment that has been described and illustrated, and that variations may be made therein without departing from the scope of the invention as found in the appended claims and equivalents thereof.

What is claimed is:

1. In an automatic teller machine including a cabinet and a lockable door, together said cabinet and said door defining a secure interior compartment, said machine including in said interior compartment a set of cassettes removably mounted within a housing, a cassette security apparatus comprising:

a) a lock base coupled to said housing; and b) a lock bar coupled to said housing and lockably engaged with said lock base, said lock bar including a first plate and a second plate secured together in substantially orthogonal relation, the lock bar positioned on the housing for preventing removal of said cassettes when lockably engaged with said lock base.

2. A cassette security apparatus according to claim 1 wherein said lock base includes a key lock and latch and wherein said lock bar includes a latch keeper whereby upon engagement of said latch within said latch keeper said lock bar is secured in position relative to said housing for preventing removal of the cassettes.

3. A cassette securing apparatus according to claim 1 wherein said first plate lies parallel to a front face of said cassettes when said lock bar is lockably engaged and said second plate lies parallel to and adjacent to side faces of said cassettes.

4. A secure automatic teller machine comprising:

a) a cabinet;

b) a door mounted to said cabinet and lockable relative to said cabinet to define an interior compartment of said cabinet;

c) a transport carriage movable mounted within said interior compartment, said transport carriage carrying at least one removable cash cassette thereon; and d) a lock bar lockably coupled to said transport carriage and having a locked position and a released position, said lock bar including a first plate and a second plate secured together in substantially orthogonal relation, the lock bar preventing removal of said cash cassette from said carriage when in said locked position and allowing removal of said cassette when in said released position.

5. An automatic teller machine according to claim 4 wherein said automatic teller machine further comprises a lock base including a key lock and latch and wherein said lock bar includes a latch keeper whereby upon engagement of said latch within said latch keeper said lock bar is secured in its locked position relative to said transport carriage.

6. An automatic teller machine according to claim 4 wherein said first plate lies parallel to a front face of said at least one removable cassette when said lock bar is in its locked position and said second plate lies parallel to and adjacent to a side face of said at least one cassette when said lock bar is in its locked position.

7. An automatic teller machine comprising:

a) a cabinet;

b) a door hinged to said cabinet and having a lock mechanism securing said door in a closed position, said cabinet and said door defining a secure interior compartment of said automatic teller machine;

c) a transport carriage movably mounted within said interior compartment;

d) a housing secured to and carried by said transport carriage, said housing including a wall having an exposed upper edge;

e) at least one cash cassette removably mounted within said housing;

f) a lock base including a latch extendible therefrom; and g) a lock bar including a hook and a latch keeper, said hook being adapted for coupling to said upper edge and said latch keeper adapted for receiving said latch to secure said bar in a locked position blocking removal of said cassette from said housing.

8. An automatic teller machine according to claim 7 wherein said lock bar includes a first plate and a second plate secured together in substantially orthogonal relation.

9. An automatic teller machine according to claim 8 wherein said first plate lies parallel to a front face of said at least one removable cassette when said lock bar is in its locked position and said second plate lies parallel to and adjacent to a side face of said at least one cassette when said lock bar is in its locked position.

10. An automatic teller machine according to claim 7 wherein said transport carriage includes a lock mechanism operable to secure said carriage and said housing within said cabinet when locked and when unlocked to allow said housing to move relative to said cabinet, said lock bar further including a cover plate attached integrally to said lock bar and covering said lock mechanism when said bar is in its locked position.

11. In an automatic teller machine including a cabinet and a lockable door, together said cabinet and said door defining a secure interior compartment, said machine including in said interior compartment a set of cassettes removably mounted within a housing, the housing comprising a transport carriage movable relative to said cabinet and includes a lock mechanism operable to secure said transport carriage within said cabinet when locked and when unlocked to allow said transport carriage to move relative to said cabinet, a cassette security apparatus comprising:

a) a lock base coupled to said housing;

b) a lock bar coupled to said housing and lockably engaged with said lock base, said lock bar positioned on the housing for preventing removal of said cassettes when lockably engaged with said lock base, and c) a cover plate attached integrally to said lock bar and covering said housing lock mechanism when said lock bar is engaged with said lock base.

12. In an automatic teller machine including a cabinet and a lockable door, together said cabinet and said door defining a secure interior compartment, said machine including in said interior compartment a set of cassettes removably mounted within a housing having a plate member having an edge, a cassette security apparatus comprising:

a) a lock base coupled to said housing; and b) a lock bar coupled to said housing and lockably engaged with said lock base, said lock bar having a hook member configured to be secured to said housing by coupling said hook member to said edge and there position the lock bar on the housing for preventing removal of said cassettes when lockably engaged with said lock base.

13. A secure automatic teller machine comprising:

a) a cabinet;

b) a door mounted to said cabinet and lockable relative to said cabinet to define an interior compartment of said cabinet;

c) a transport carriage movably mounted within said interior compartment and includes a housing mounted thereon, the combined assembly of said transport carriage and said housing being movable relative to said cabinet, the transport carriage further including a lock mechanism operable to secure said housing within said cabinet when locked and when unlocked to allow said housing to move slidably relative to said cabinet, said transport carriage carrying at least one removable cash cassette thereon; and d) a lock bar lockably coupled to said transport carriage and having a locked position and a released position, said lock bar preventing removal of said cash cassette from said carriage when in said locked position and allowing removal of said cassette when in said released position, the lock bar further having a cover plate attached thereto configured to cover said housing lock mechanism when said lock bar is in its locked position.

14. A secure automatic teller machine comprising:

a) a cabinet;

b) a door mounted to said cabinet and lockable relative to said cabinet to define an interior compartment of said cabinet;

c) a transport carriage movably mounted within said interior compartment, said transport carriage being coupled to a housing carrying at least one removable cash cassette thereon, the housing including a plate member having an edge, and d) a lock bar having a hook member configured for coupling to said housing edge and lockable coupling to said transport carriage and having a locked position and a released position, said lock bar preventing removal of said cash cassette from said carriage when in said locked position and allowing removal of said cassette when in said released position.

* * * * *